United States Patent [19]

Tucker

[11] 4,291,653

[45] Sep. 29, 1981

[54] DOOR CAR STARTER

[76] Inventor: Cleveland T. Tucker, Rte. 2, Box 49B, Dinwiddie, Va. 23841

[21] Appl. No.: 816,973

[22] Filed: Jul. 19, 1977

[51] Int. Cl.[3] ..... F02N 17/00

[52] U.S. Cl. ..... 123/179 BG; 123/198 B; 180/286

[58] Field of Search ..... 123/179 B, 198 B, 179 BG; 180/111, 112, 113, 286, 271; 307/10 LS; 290/DIG. 3

[56] References Cited

U.S. PATENT DOCUMENTS

| | | | |
|---|---|---|---|
| 2,034,233 | 3/1936 | Hasselbaum | 180/111 |
| 2,182,426 | 12/1939 | Courcier, Sr. | 180/111 |
| 2,360,227 | 10/1944 | Hemphill | 180/111 |
| 2,873,382 | 2/1959 | Herring | 123/179 B |
| 2,904,121 | 9/1959 | Honeyman | 123/198 B |
| 3,443,557 | 6/1969 | Hebert | 123/179 B |
| 3,721,310 | 3/1973 | Thomas | 180/111 |

*Primary Examiner*—Ira S. Lazarus

*Assistant Examiner*—Magdalen Moy

*Attorney, Agent, or Firm*—Griffin, Branigan & Butler

[57] ABSTRACT

A combustion-engine vehicle includes a starting system which starts the engine in response to one of the vehicle's doors being operated. When the door is opened a circuit is completed from the vehicle's battery through a dome light switch to the ignition coil and to a starter-motor solenoid switch. A vacuum switch coupled to the engine's intake manifold opens the circuit to the starter-motor solenoid switch when it senses that the engine has been started. A door-sensor control connected between the dome light switch and the starter-motor solenoid switch and the ignition coil includes two on/off switches connected in series, with the starter-motor solenoid switch being connected to a downstream terminal of the first on/off switch and the ignition coil being coupled to a downstream terminal of the second on/off switch. The vacuum switch is connected in series in a line to the starter-motor solenoid switch.

9 Claims, 2 Drawing Figures

DOOR CAR STARTER

BACKGROUND OF THE INVENTION

This invention relates broadly to the art combustion engine vehicles and more specifically to remote starting mechanisms therefor.

It is often desirable in certain situations for drivers to enter cars, trucks, or the like and drive away as fast as possible, such as with police vehicles, ambulances and other emergency vehicles. In these situations it is often burdensome for a driver to first enter a vehicle and settle behind the steering wheel before he can start his car. Thus, it is an object of this invention to provide a mechanism for starting the combustion-engine of a vehicle simultaneously with an occupant thereof entering the vehicle.

It is a further object of this invention to provide such a door-actuated starting mechanism which allows the engine of a vehicle to otherwise be started normally where desired and which involves only a small structural modification from conventional vehicles.

It is yet another object of this invention to provide a door-actuated starting mechanism having adequate security in that an owner of a vehicle including this door-operated mechanism can selectively set it so that only he can use it in the desired manner.

It is still another object of this invention to provide such a mechanism which is inexpensive to manufacture and install.

SUMMARY OF THE INVENTION

According to principles of this invention a closure sensor control comprising two on/off switches in series connect a starter-motor solenoid switch and an ignition coil of a combustion-engine vehicle with an electrical power source through a dome light switch which is operated by the vehicles's door. The starter-motor solenoid switch is connected to the downstream terminal of the first on/off switch via a vacuum switch which is mounted on an intake manifold of the combustion engine. The ignition coil is connected to the downstream terminal of the second on/off switch. When the engine starts the vacuum switch opens the line leading to the starter-motor solenoid switch, thereby deenergizing the starter motor. A fuel-line cut-off system is included to prevent unauthorized usage of the vehicle when it is set to be started by opening its door.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
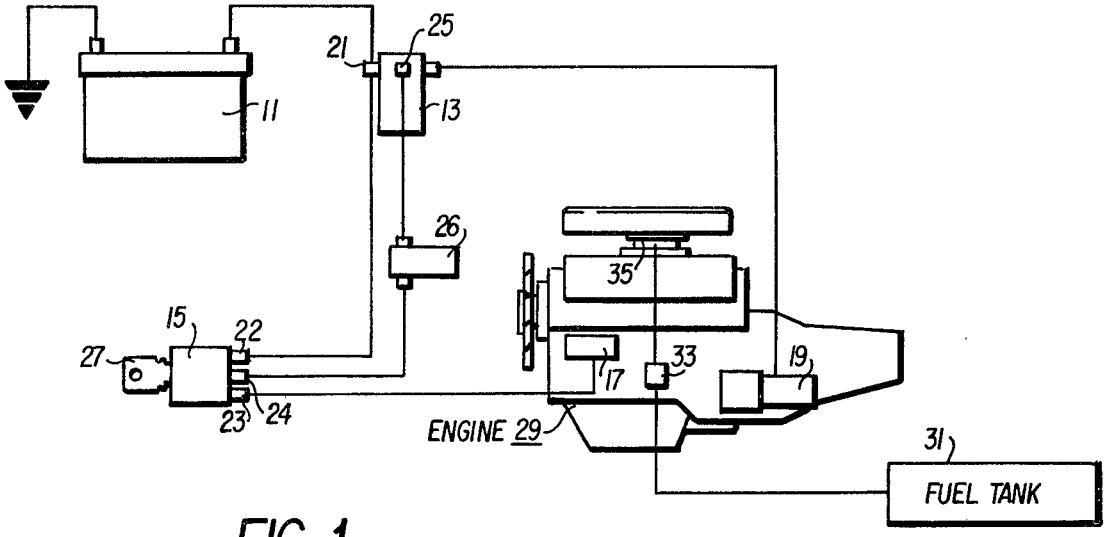
FIG. 1 (PRIOR ART)
FIG. 1 is a block diagram of a fragmented portion of a conventional prior-art combustion-engine vehicle's electrical system.

Referring now to FIG. 1, a combustion-engine electrical system, as is pertinent with regard to this invention, includes a power source 11 (such as a battery or generator), a starter-motor solenoid switch 13, a key-operated ignition switch 15, an ignition coil 17, and a starter motor 19. Energy is coupled from the power source 11 to an input terminal 21 of the starter-motor solenoid switch 13 and to a primary terminal 22 of the ignition switch 15. Energy is connected from a coil output terminal 23 of the ignition switch 15 to the ignition coil 17 and from a start output terminal 24 of the ignition switch 15 to a start input terminal 25 of the starter solenoid switch 13. A neutral switch 26, which is operated by a gear selector (not shown) is in the circuit between the ignition-switch start output terminal 24 and the starter-motor solenoid switch 13 to ensure that the car is only started when its gears are set in the neutral position. When a key 27 is rotated to turn "on" the ignition switch 15, current flows from the power source 11 through the ignition-switch coil output terminal 23 to the ignition coil 17. When the key 27 is rotated further to the "start" position current also flows from the ignition-switch start output terminal 24, through the neutral switch 26 to the start input terminal 25 on the starter-motor solenoid switch 13. The starter-motor solenoid switch 13 is thereby energized to pass a current from the power source 11 to the starter motor 19 to crank the engine 29 and start it. An operator, upon realizing that the car has started, releases the key 27 allowing it to move back to the "on" position to maintain energization of the ignition coil 17 but to deenergize the starter-motor solenoid switch 13 and the attached starter motor 19.

The engine 29 is fed by a fuel tank 31, a fuel pump 33, and a carburetor 35 to maintain this operation.

Figure 2:
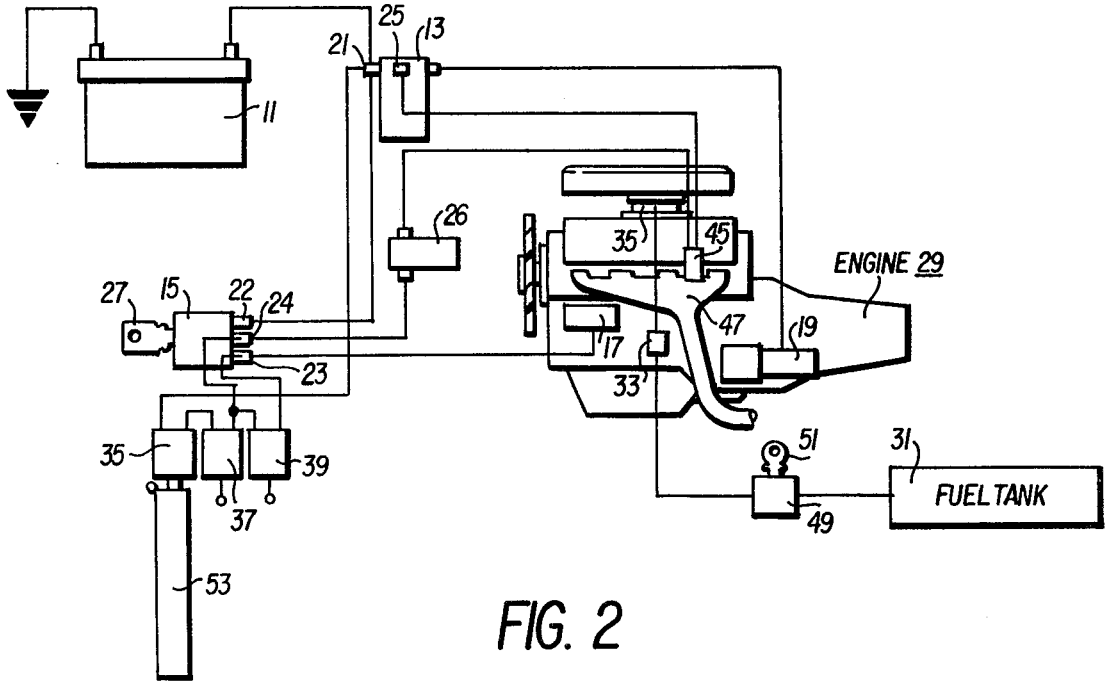
FIG. 2 is a block diagram of a fragmented portion of a combustion-engine's electrical system employing principles of this invention.

Now looking at FIG. 2 which shows a modified electrical system, so far as it pertains to this invention, including aspects of this invention, the power source 11, in addition to being connected directly to the primary terminal 22 of the ignition switch 15, is also connected to one side of a conventional door-actuated, dome light switch 35. The dome light switch 35 is closed when a vehicle's door 53 is opened to energize a dome light in the vehicle's cab and is opened when the vehicle's door is closed. The system further includes a closure sensor control comprising a first on/off switch 37, and a second on/off switch 39. These two switches are connected in series, with the upstream terminal of the first on/off switch 37 being connected to the downstream terminal of the dome light switch 35 and the downstream terminal of the first on/off switch 37, in addition to being coupled to the upstream terminal of the second on/off switch 39, being coupled to the ignition switch's start output terminal 24. The downstream terminal of the second on/off switch 39 is attached to the ignition switch's coil output terminal 23.

In addition, in the system of FIG. 2, rather than the neutral switch 26 being coupled directly to the start input terminal 25 of the starter-motor solenoid switch 13, it is connected thereto via a vacuum switch 45. The vacuum switch 45 is mounted on an intake manifold 47 of the engine 29. The vacuum switch 45 is closed when the engine 29 is not running and there is, therefore, little vacuum in the intake manifold 47. However, the vacuum switch 45 is opened when the engine 29 starts in response to a reduced pressure in the intake manifold 47. Such vacuum switches are old in the art, with one being sold by American Motors part number 8127214 under the name "Vacuum Neutral Safety Switch." This switch was standard on 1961 Ramblers.

In the system of FIG. 2 a key-actuated fuel cut-off valve 49 is included in the fuel line from the fuel tank 31 to the fuel pump 33. The fuel cut-off valve 49 can be selectively set by a key 51 to allow flow from the fuel tank 31 to the fuel pump 33, or to not allow such flow. Again, key actuated fuel valves are old in the art, with one which will work in this invention being sold by J. C. Whitney, Catalog No. 342, Stock No. 122171T. J. C. Whitney calls their key actuated valve an "In Line Lock."

In operation of the system of FIG. 2, when it is desired that the engine 29 starts upon the opening of one of the vehicle's doors 53, the key 27 need not be in the ignition switch but the on/off switches 37 and 39 must be set in "closed" positions. When the door 53 is opened, the dome switch 35 is thereby closed to provide energy to the starter motor solenoid switch 13 via the first on/off switch 37, the neutral switch 26, and the vacuum switch 45. The ignition coil 17 is energized via the second on/off switch 39. The starter motor 19 is thusly energized to start the engine 29. Upon starting of the engine 29 the vacuum switch 45 senses a reduced pressure, or partial vacuum, in the intake manifold and deenergizes the starter-motor solenoid switch 13, which, in turn, deenergizes the starter motor 19. Thus, the engine is started as the operator opens the door and climbs into the cab of the vehicle.

It is noted that the operator must insert a key in the ignition switch 15 before he closes the door 53 in order to ensure that the motor remains running once the door is closed. In situations where the operator knows that he will be leaving shortly, he can leave the key 27 in the ignition switch 15 so as to avoid having to later insert the key after the engine 29 is started.

It is further noted that two on/off switches 37 and 39 are utilized to avoid having the start output terminal 24 and the coil output terminal 23 of the ignition switch 15 shorted when the first and second on/off switches 37 and 39 are open.

The fuel cut-off valve 49 is turned off when the vehicle is set to start by opening its door 53 so that if an unauthorized person should open the door 53 of the car, and thereby start the engine, he could only drive several blocks before the engine 29 would be deactivated by fuel starvation. On the other hand, when the authorized operator starts the car by opening the door 53 and begins to drive the vehicle he can, simultaneously with driving, insert the key 51 and activate the fuel cut-off valve 49 to cut on the flow of fuel from the tank 31.

It will be appreciated that the mechanism described herein allows an operator to start a combustion-engine vehicle by merely opening its door, thereby allowing him to enter the vehicle and drive away more quickly than with conventional prior-art starting systems. It will also be appreciated that this system provides security against unauthorized persons stealing vehicles having this mechanism mounted thereon.

While the invention has been particularly shown and described with reference to a preferred embodiment, it will be understood by those skilled in the art that various changes in form and detail may be made therein without departing from the spirit and scope of the invention. For example, it would be possible to include a timing ignition switch which is activated by the dome light switch 35 to ensure motor operation for a set period of time after the door 53 is closed and the dome light switch 35 is opened without the necessity of immediately using a key 27 to operate the ignition switch 15. Further, this system could be easily adapted to manual transmission vehicles.

The embodiments of the invention in which an exclusive property or privilege are claimed are defined as follows:

1. An automatic starting system for an internal-combustion engine powered vehicle having an operator's cab comprising:

a starting means for starting said engine;

a battery for energizing said starting means;

one or more vehicle closure means providing access to the operator's cab;

a closure sensor means for monitoring at least one of said closure means and for allowing energy to flow from said battery to the starting means and said engine in response to one of said closure means being opened;

a closure sensor control means for selectively activating and deactivating the closure sensor means;

an internal-combustion engine sensor which automatically interrupts the flow of energy to said starting means in response to said engine starting.

2. An automatic starting system as in claim 1 wherein said vehicle closure sensor is a dome light switch.

3. An automatic starting system as in claim 1 wherein said closure-sensor control means includes first and second on/off switches connected in series with said closure sensor means, a downstream terminal of said first on/off switch being connected to said starting means for starting said engine and a downstream terminal of said second on/off switch being connected to an ignition coil of said engine.

4. An automatic starting system as in claim 3 but further including a key operated valve means mounted in a fuel line of said internal-combustion engine for selectively allowing and not allowing fuel to flow to said internal-combustion engine.

5. An automatic starting system as in claim 1 wherein is further included a normally-closed combustion engine sensor switch connected to the intake manifold of said engine, said combustion engine sensor being coupled in series in the circuit from said closure sensor control means to said starting means for opening said circuit upon the starting of said engine in response to a reduced pressure in said intake manifold.

6. An automatic starting system as in claim 5 wherein said vehicle closure sensor is a dome light switch.

7. An automatic starting system as in claim 6 wherein said closure-sensor control means includes first and second on/off switches connected in series with said closure sensor means, a downstream terminal of said first on/off switch being connected to said starting means for starting said engine and a downstream terminal of said second on/off switch being connected to an ignition coil of said engine.

8. An automatic starting system as in claim 7 but further including a key operated valve means mounted in a fuel line of said internal-combustion engine for selectively allowing and not allowing fuel to flow to said internal-combustion engine.

9. An automatic starting system as in claim 1 but further including a key operated valve means mounted in a fuel line of said internal combustion engine for selectively allowing and not allowing fuel to flow to said internal-combustion engine.

* * * * *

UNITED STATES PATENT AND TRADEMARK OFFICE

CERTIFICATE OF CORRECTION

PATENT NO. : 4,291,653

DATED : September 29, 1981

INVENTOR(S) : Cleveland T. Tucker

It is certified that error appears in the above—identified patent and that said Letters Patent is hereby corrected as shown below:

ON THE TITLE PAGE:
In the abstract, line 3, delete "operated" and insert -- opened --.
Column 4, bridging lines 18 and 19, delete "and said engine".

Signed and Sealed this

*Second* Day of *March 1982*

[SEAL]

*Attest:*

GERALD J. MOSSINGHOFF

*Attesting Officer*

*Commissioner of Patents and Trademarks*